US009885514B2

(12) United States Patent
Giacomini et al.

(10) Patent No.: US 9,885,514 B2
(45) Date of Patent: Feb. 6, 2018

(54) FOLDABLE HINGE FOR REFRIGERATOR DOOR

(71) Applicant: Whirlpool Corporation, Benton Harbor, MI (US)

(72) Inventors: Neomar Giacomini, St. Joseph, MI (US); Axel Julio Ramm, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/959,670

(22) Filed: Dec. 4, 2015

(65) Prior Publication Data

US 2017/0159993 A1 Jun. 8, 2017

(51) Int. Cl.

| | |
|---|---|
| ***A47B 96/04*** | (2006.01) |
| ***F25D 23/02*** | (2006.01) |
| ***E05D 7/10*** | (2006.01) |
| *E05D 5/04* | (2006.01) |

(52) U.S. Cl.

CPC ..... *F25D 23/028* (2013.01); *E05D 7/1044* (2013.01); *E05D 5/04* (2013.01); *E05Y 2900/31* (2013.01); *F25D 2323/024* (2013.01)

(58) Field of Classification Search

CPC ..... E05D 7/0009; E05D 7/1061; E05D 2011/0063; E05D 11/0054; E05D 3/02; E05D 7/12; E05D 7/00; F25D 2323/024; F25D 23/028; E05Y 2900/31; Y10T 16/554; Y10T 16/5363

USPC ..... 312/405

See application file for complete search history.

(56) References Cited

U.S. PATENT DOCUMENTS

| | | | | |
|---|---|---|---|---|
| 699,530 | A | 5/1902 | Jackson | |
| 831,801 | A * | 9/1906 | Roberts | E05D 3/02 16/270 |
| 5,659,928 | A | 8/1997 | Komaki | |
| 5,870,801 | A * | 2/1999 | Kim | E05D 7/12 16/267 |
| 5,884,366 | A * | 3/1999 | Jeong | E05D 7/123 16/266 |
| 5,960,518 | A * | 10/1999 | Jeong | E05D 7/123 16/257 |
| 6,070,300 | A * | 6/2000 | Shin | E05D 7/1044 16/382 |

(Continued)

*Primary Examiner* — Daniel J Troy
*Assistant Examiner* — Timothy M Ayres
(74) *Attorney, Agent, or Firm* — Price Heneveld LLP

(57) ABSTRACT

A refrigerator is provided that includes a cabinet having a cabinet wrapper, a door coupled to the cabinet and operable between substantially open and closed positions, and a hinge assembly operatively coupled to the cabinet and to the door. The hinge assembly includes a hinge body defining a door portion and a cabinet portion, the door portion coupled to the door and the cabinet portion coupled to an external side of the cabinet wrapper. A foldable hinge connects the door portion and cabinet portion of the hinge body such that the door portion may rotate relative to the cabinet wrapper. A reinforcement member is positioned on an internal side of the cabinet wrapper and coupled to the hinge body. A locking mechanism is positioned on the door portion. The locking mechanism is configured to engage the reinforcement member and lock the door portion in place.

11 Claims, 7 Drawing Sheets

(56) References Cited

U.S. PATENT DOCUMENTS

| | | | | |
|---|---|---|---|---|
| 6,085,385 | A * | 7/2000 | Joo | E05D 7/12 16/262 |
| 6,928,713 | B2 | 8/2005 | Baer | |
| 7,065,832 | B2 * | 6/2006 | Pohl | F25D 23/028 16/221 |
| 7,080,428 | B2 | 7/2006 | Hyde | |
| 8,245,352 | B2 * | 8/2012 | Park | E05D 7/12 16/258 |
| 8,506,026 | B2 * | 8/2013 | Kim | F25D 23/028 312/405 |
| 2005/0166363 | A1 * | 8/2005 | Hoffman | B60J 5/0472 16/244 |
| 2010/0026155 | A1 * | 2/2010 | Yun | F25D 23/028 312/405 |

* cited by examiner

FOLDABLE HINGE FOR REFRIGERATOR DOOR

BACKGROUND

Often, during transport and installation of refrigerators and appliances, doors of the appliance may be removed in order to facilitate movement through doors and other confined spaces. Removal of the hinges may result in improper alignment of the refrigerator doors when reattached.

BRIEF SUMMARY OF THE DISCLOSURE

According to one aspect of the disclosure, a refrigerator is provided that includes a cabinet having a cabinet wrapper, a door coupled to the cabinet and operable between substantially open and closed positions, and a hinge assembly operatively coupled to the cabinet and to the door. The hinge assembly includes a hinge body defining a door portion and a cabinet portion, the door portion coupled to the door and the cabinet portion coupled to an external side of the cabinet wrapper. A foldable hinge connects the door portion and cabinet portion of the hinge body such that the door portion may rotate relative to the cabinet wrapper. A reinforcement member is positioned on an internal side of the cabinet wrapper and coupled to the hinge body. A locking mechanism is positioned on the door portion. The locking mechanism is configured to engage the reinforcement member and lock the door portion in place.

According to another aspect of the present disclosure, a refrigerator is provided that includes a cabinet having a cabinet wrapper, a door coupled to the cabinet, and a hinge assembly operatively coupled to the cabinet and to the door. The hinge assembly has a hinge body defining a door portion and a cabinet portion, the door portion comprising a hinge pin to which the door is rotatably coupled. The cabinet portion is coupled to the cabinet. A foldable hinge connects the door portion and cabinet portion of the hinge body such that the door portion is rotatable. A reinforcement member defines a protrusion extending through the cabinet wrapper and the hinge body.

According to yet another aspect of the present disclosure, a refrigerator door hinge assembly is provided that includes a hinge body defining a door portion and a cabinet portion. The door portion and cabinet portion are coupled through a foldable hinge such that the door portion may pivot relative to the cabinet portion. The door portion defines an aperture. A reinforcement is coupled to the hinge body, the reinforcement defining a protrusion configured to pass through the aperture of the door portion. A locking mechanism is positioned on the door portion and configured to engage the protrusion such that the relative motion between the door portion and the cabinet portion is prevented.

These and other features, advantages, and objects of the present disclosure will be further understood and appreciated by those skilled in the art by reference to the following specification, claims, and appended drawings.

BRIEF DESCRIPTION OF THE DRAWINGS

The foregoing summary, as well as the following detailed description of the disclosure, will be better understood when read in conjunction with the appended drawings. For the purpose of illustrating the disclosure, certain embodiments are shown in the drawings. It should be understood, however, that the disclosure is not limited to the precise arrangements and instrumentalities shown. Drawings are not necessarily to scale. Certain features of the disclosure may be exaggerated in scale or shown in schematic form in the interest of clarity and conciseness.

DETAILED DESCRIPTION

As required, detailed embodiments of the present disclosure are disclosed herein. However, it is to be understood that the disclosed embodiments are merely exemplary of the disclosure that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present disclosure.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

It is to be understood that the present disclosure is not limited to the particular embodiments described below, as variations of the particular embodiments may be made and still fall within the scope of the appended claims. It is also to be understood that the terminology employed is for the purpose of describing particular embodiments, and is not intended to be limiting. Instead, the scope of the present disclosure will be established by the appended claims.

Figure 1:
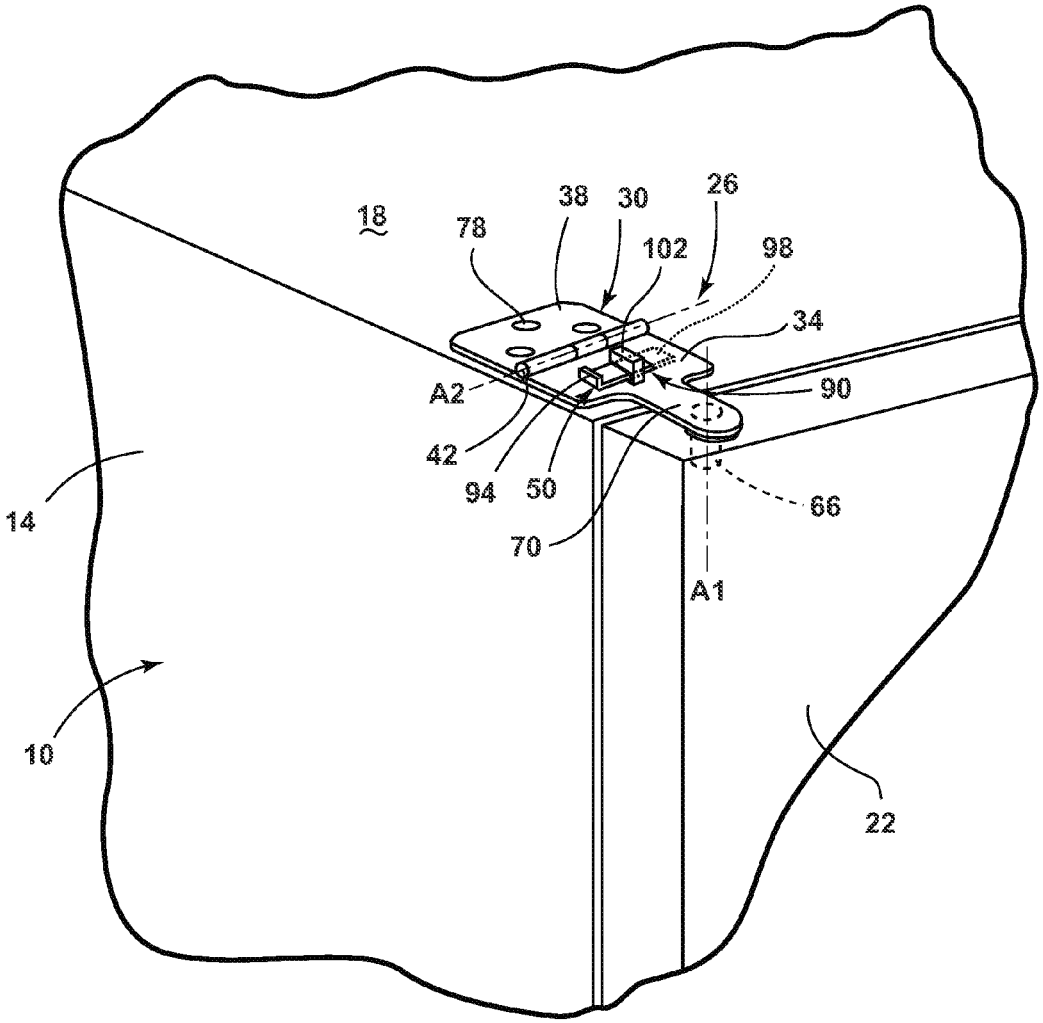
FIG. 1 is a top perspective view of a refrigerator, according to one embodiment.

For purposes of description herein, the terms "upper," "lower," "right," "left," "rear," "front," "vertical," "horizontal," and derivates thereof shall relate to the disclosure as oriented in FIG. 1, unless stated otherwise. However, it is to be understood that the disclosure may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2A:
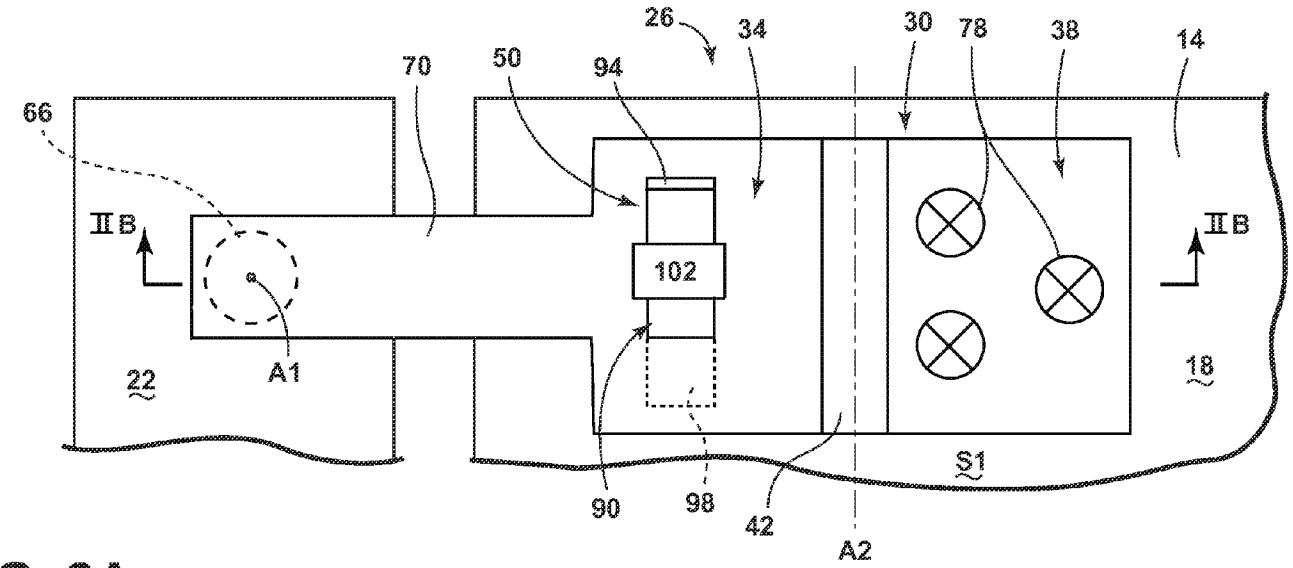
FIG. 2A, is a top perspective view of a hinge assembly, according to one embodiment.
Figure 2B:
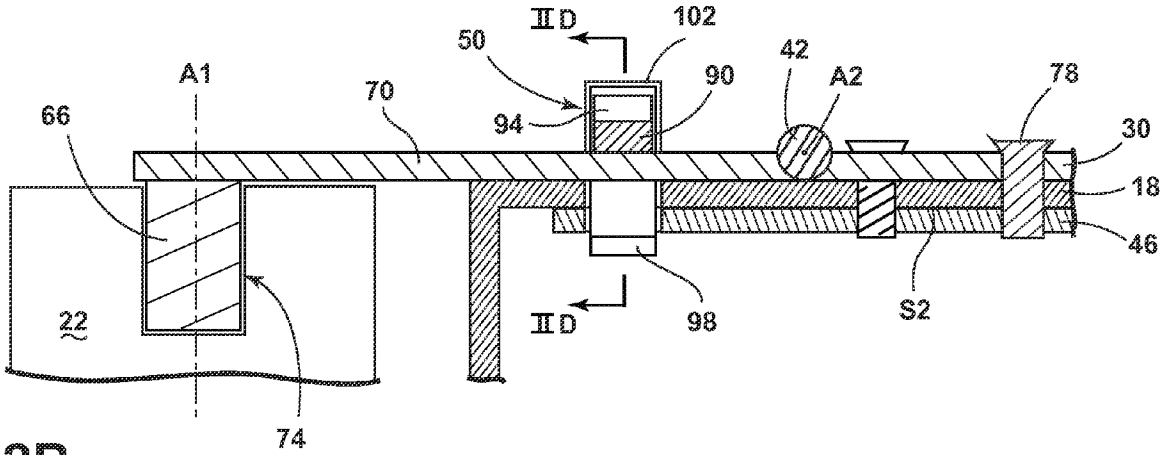
FIG. 2B is a cross-sectional view of the hinge assembly taken at line IIB of FIG. 2A in an unfolded configuration.
Figure 2C:
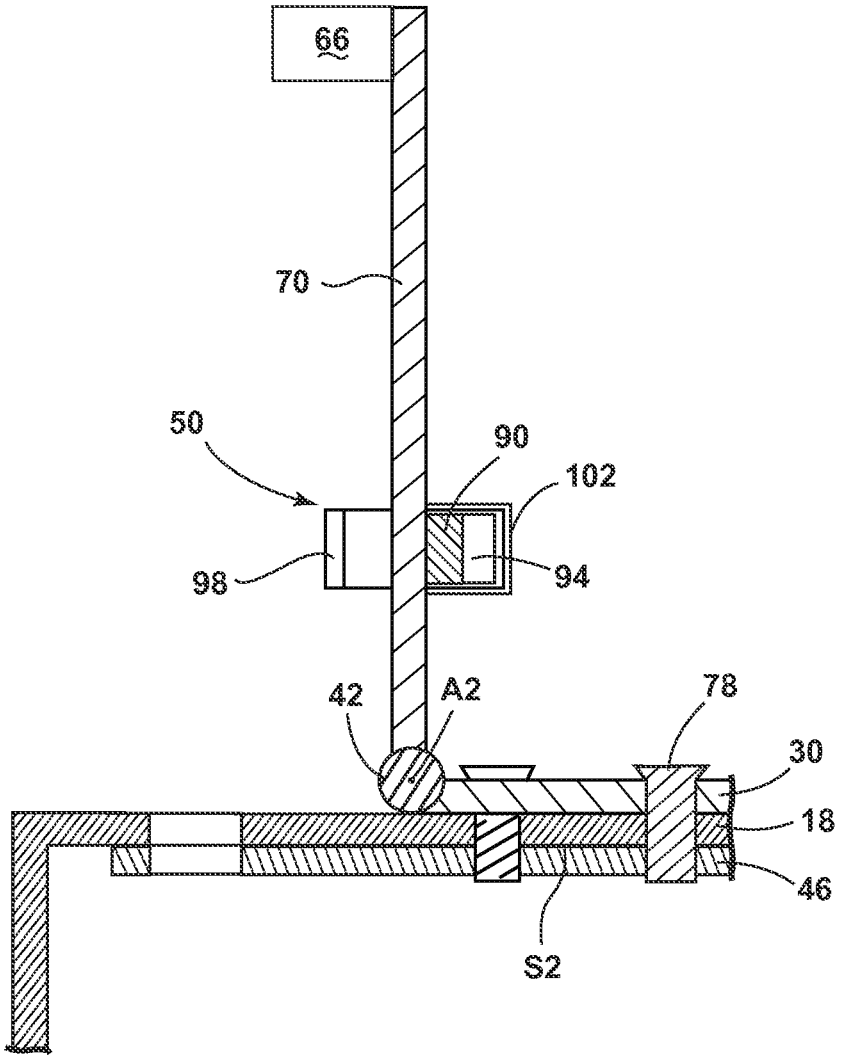
FIG. 2C is a cross-sectional view of the hinge assembly taken at line IIB of FIG. 2A in a folded configuration.
Figure 2D:
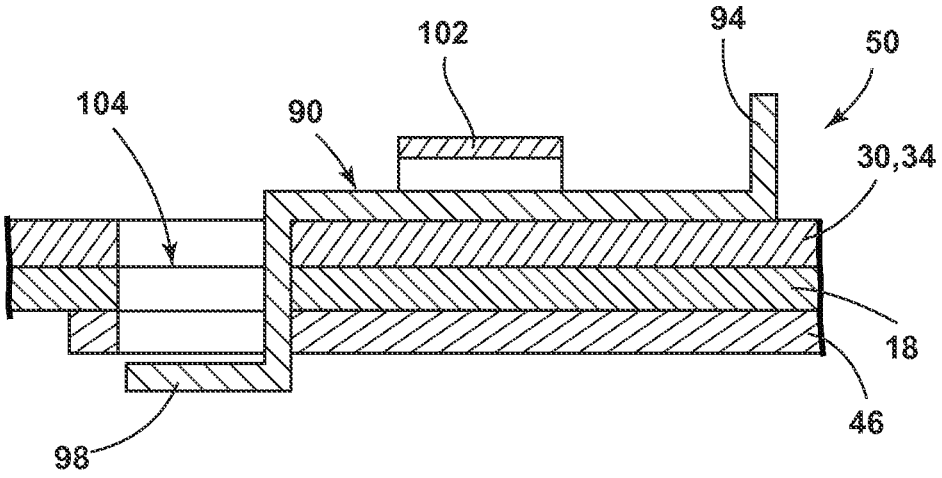
FIG. 2D is a cross-sectional view of the hinge assembly taken at IID of FIG. 2B.

Referring to FIGS. 1-2D, depicted is a refrigerator 10 having a cabinet 14 and a cabinet wrapper 18. A door 22 is coupled to the cabinet 14 and operable between substantially open and closed positions. A hinge assembly 26 is operatively coupled to the cabinet 14 and to the door 22. The hinge assembly 26 includes a hinge body 30 defining a door portion 34 and a cabinet portion 38. The door portion 34 is coupled to the door 22 and the cabinet portion 38 is coupled to an external side 51 of the cabinet wrapper 18. A foldable hinge 42 connects the door portion 34 and cabinet portion 38 of the hinge body 30 such that the door portion 34 may rotate relative to the cabinet wrapper 18. A reinforcement member 46 is positioned on an internal side S2 of the cabinet wrapper 18 and coupled to the hinge body 30. A locking mechanism 50 is positioned on the door portion 34. The locking mechanism 50 is configured to engage the reinforcement member 46 and lock the door portion 34 in place.

Referring now to FIG. 1, the refrigerator 10 may take a variety of configurations, including French door, side-by-side, top freezer, bottom freezer, counter depth, compact, built-in, and other types of refrigerators. The door 22 may be either a refrigerator door or a freezer door. Although the hinge assembly 26 is depicted as positioned on left side of the refrigerator 10, the hinge assembly 26 may be used on a right side of the refrigerator 10, as well as other locations (top, center, bottom, or sides). In various embodiments, the hinge assembly 26 may be hidden or concealed using a cover which may be more aesthetically pleasing than the hinge assembly 26.

Referring now to FIGS. 2A-2C, the hinge assembly 26 operatively couples the door 22 to the cabinet wrapper 18 of the cabinet 14. The hinge assembly 26 includes the hinge body 30 and the reinforcement member 46. The hinge assembly 26 includes a hinge pin 66 positioned at an end of an arm 70. The hinge pin 66 and the arm 70 are both positioned on the door portion 34 of the hinge assembly 26. The hinge pin 66 is configured to mate with a door insertion hole 74 defined by the door 22. The hinge pin 66 and the door insertion hole 74 may be configured to snap together such that the door 22 may rotate between substantially open and closed positions relative to the cabinet 14 about a first axis A1. The hinge pin 66 may be removed from the door insertion hole 74 such that the door 22 may be removed from the refrigerator 10. In various embodiments, the hinge pin 66 may be configured to move vertically along the first axis A1 (e.g., up and down) through the arm 70 in order to assist (e.g., decrease interference between the hinge pin 66 and the door insertion hole 74) with the removal of the hinge pin 66 from the door insertion hole 74. The arm 70 of the door portion 34 extends from the hinge pin 66 toward the foldable hinge 42 of the hinge body 30. Disposed through the cabinet portion 38 of the hinge body 30 is at least one fastener 78. The fasteners 78 are disposed through the hinge body 30, the cabinet portion 38, the cabinet wrapper 18 and are fastened to the reinforcement member 46 such that tightening of the fasteners 78 cause the hinge body 30 and the reinforcement member 46 to tighten on the cabinet wrapper 18. The fasteners 78 may be screws, bolts, shanks, rivets, cotter pins and/or other suitable fasteners. Use of the fasteners 78 couples the hinge body 30 to the cabinet wrapper 18 such that the cabinet portion 38 may not move. The reinforcement member 46 may have a "floating" configuration, or may be partially supported by insulation within the cabinet 14 of the refrigerator 10.

Referring now to FIGS. 2B and 2C, the hinge body 30 of the hinge assembly 26 includes the foldable hinge 42 which pivotally couples the door portion 34 to the cabinet portion 38. The foldable hinge 42 is configured to allow the door portion 34 of the hinge body 30 to pivotally rotate about a second axis A2 away from the cabinet 14 such that the hinge body 30 may rotate between an unfolded configuration (FIG. 2B) and a folded configuration (FIG. 2C). The snap fit connection between the door 22 and the hinge pin 66 may be separated such that the door 22 can be removed from coupling with the hinge assembly 26 prior, during or after rotation of the door portion 34 away from the cabinet 14. As explained above, the hinge pin 66 may be configured to move along the first axis A1 relative to the arm 70. In one embodiment, the hinge pin 66 and a hole in the arm 70 may be threaded such that rotational motion of the hinge pin 66 results in the hinge pin 66 moving through the arm 70. In other embodiments, the hinge pin 66 may be configured to slide through the arm 70. Movement of the hinge pin 66 through the arm 70 out of the door insertion hole 74 may be advantageous in providing more room for the hinge pin 66 to rotate out of the hole 70 without becoming jammed due to interference. Additionally or alternatively, the hinge pin 66 may have a chamfered end to decrease or minimize interference between the hinge pin 66 and the door insertion hole 70. Use of the movable and/or chamfered hinge pin 66 may allow easier removal from the door insertion hole 74 while the arm 70 is rotating. After removal of the door 22, the hinge body 30 may be rotated into the folded configuration via rotation about the second axis A2. The hinge assembly 26, in various embodiments, permits easy removal of the door(s) 22 such that the depth of the refrigerator 10 (FIG. 1) may be reduced and the refrigerator 10 may be moved through confined spaces.

Referring now to FIG. 2D, the locking mechanism 50 may be used to lock the door portion 34 of the hinge body 30 in the unfolded configuration. In the depicted embodiment, the locking mechanism 50 may include a slide lock 90 having a lock handle 94 and a lock tab 98. The slide lock 90 may be slidably disposed through a lock keeper 102. The lock keeper 102 may be integrally defined by the door portion 34 of the hinge body 30 or may be coupled thereto. The slide lock 90 extends through the lock keeper 102, and a lock aperture 104 defined by holes in the hinge body 30, the cabinet wrapper 18 and the reinforcement member 46. The slide lock 90 may be slid between engaged and disengaged configurations through use of the lock handle 98. In the engaged position, the lock tab 98 engages an underside of the reinforcement member 46. Engagement of the lock tab 98 with the reinforcement member 46 prevents the door portion 34 from pivoting. Once the slide lock 90 is slid to the disengaged configuration, the lock tab 98 is aligned with the lock aperture 104 such that rotation of the door portion 34 of the hinge body 30 allows the slide lock 90 and lock tab 98 to be removed from the reinforcement member 46.

Figure 3A:
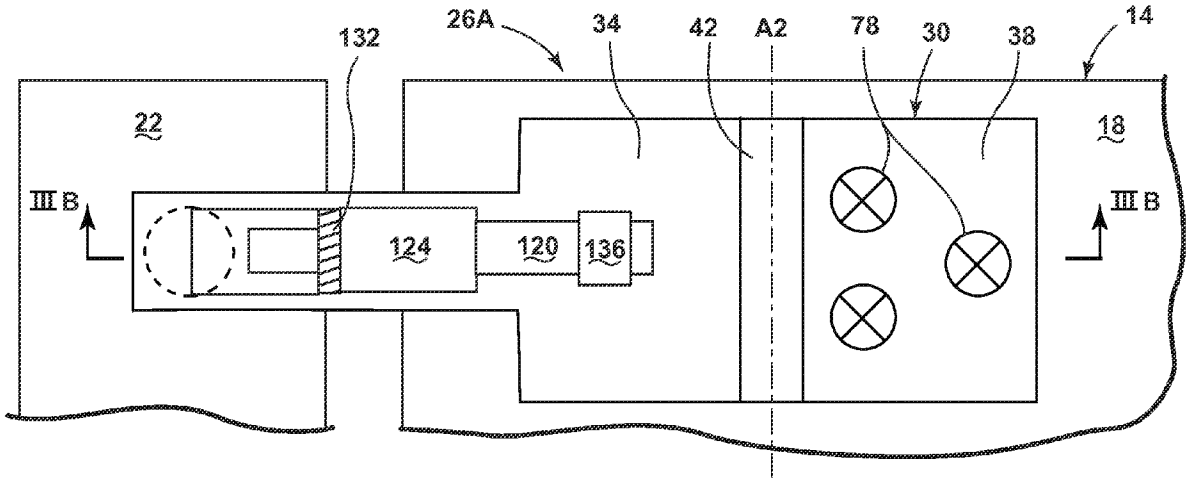
FIG. 3A is a top perspective view of the hinge assembly, according to another embodiment.
Figure 3B:
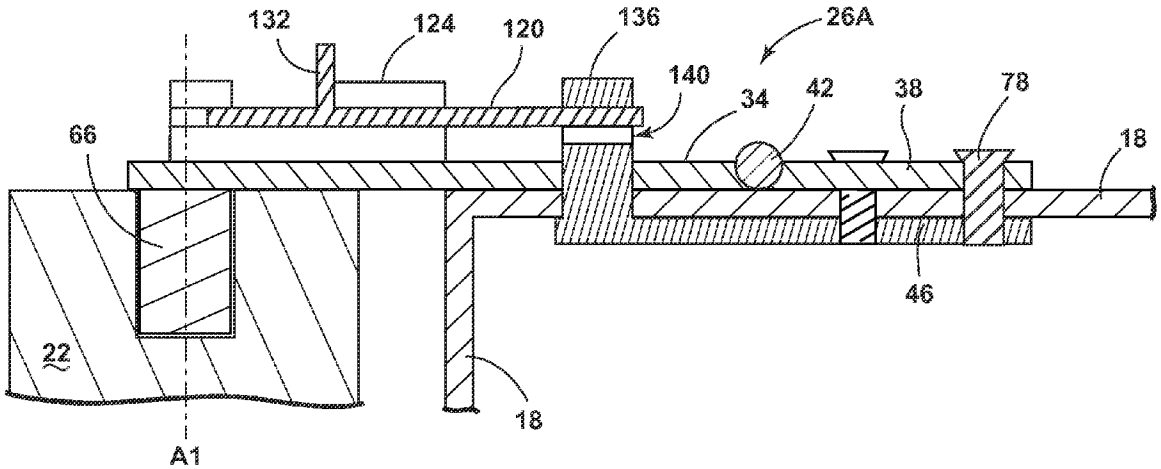
FIG. 3B is a cross-sectional view of the hinge assembly taken at line IIIB of FIG. 3A.

Referring now to FIGS. 3A and 3B, another embodiment of the hinge assembly 26 is depicted as hinge assembly 26A. The hinge assembly 26A includes a slide bolt 120 slidably disposed within a bracket 124. The slide bolt 120 includes a handle 132 which may be used to slide the slide bolt 120 back and forth through the bracket 124. The bracket 124 is configured to hold the slide bolt 120 and keep the bolt 120 in proper alignment. In the depicted embodiment, the reinforcement member 46 integrally defines a protrusion 136 defining an eyelet 140. It will be understood that the protrusion 136 may not be integrally defined, but rather merely coupled to the reinforcement member 46 without departing from the spirit of the disclosure. The protrusion 136 is configured to extend through the cabinet wrapper 18 and the door portion 34 of the hinge body 30. The eyelet 140 is configured to accept at least a portion of the slide bolt 120. Insertion of the slide bolt 120 into the eyelet 140 resists and/or prevents pivotal movement of the door portion 34 relative to the cabinet 14. By sliding the slide bolt 120 away from the protrusion 136 and out of the eyelet 140, the door portion 34 of the hinge body 30 may be placed in the folded configuration.

Figure 4A:
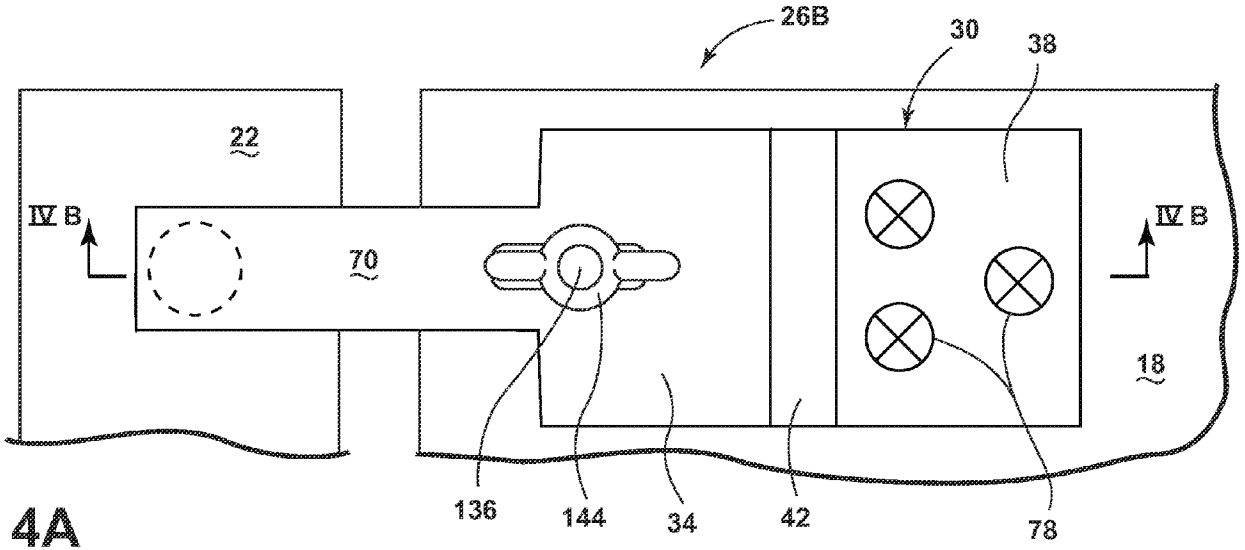
FIG. 4A is a top perspective view of the hinge assembly according to yet another embodiment.
Figure 4B:
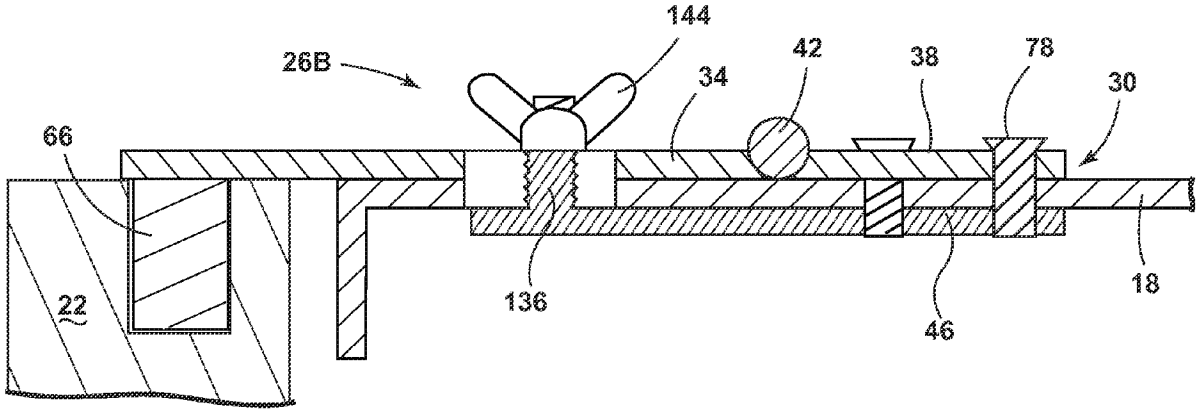
FIG. 4B is a cross-sectional view of the hinge assembly taken at line IVB of FIG. 4A.

Referring now to FIGS. 4A and 4B, another embodiment of the hinge assembly 26 is depicted as hinge assembly 26B. The hinge assembly 26B is similar to the hinge assembly 26A in that hinge assembly 26B includes the protrusion 136 defined by the reinforcement member 46. The protrusion 136 is threaded and configured to accept a nut 144. The nut 144 may be a hex, wing, cap, acorn, nylon insert, jam or other type of nut 144 configured to engage the threads of the protrusion 136. The nut 144 may be tightened down along the protrusion 136 and against the door portion 34 of the hinge body 30 such that pivotal motion of the door portion 34 may be resisted. It will be understood that the threads of the protrusion 136 may be replaced by a similar structure configured to engage the nut 144 or another fastener. For example the threads may be replaced with an aperture such that a retaining clip may be inserted through, similar to a cotter pin. It will be understood that the protrusion 136 and nut 144 may be replaced by threaded holes in the hinge body 30 and the reinforcement member 46 such that a bolt or wing bolt may be screwed therethrough to secure the door portion 34 of the hinge assembly 26 to the cabinet 14.

Figure 5:
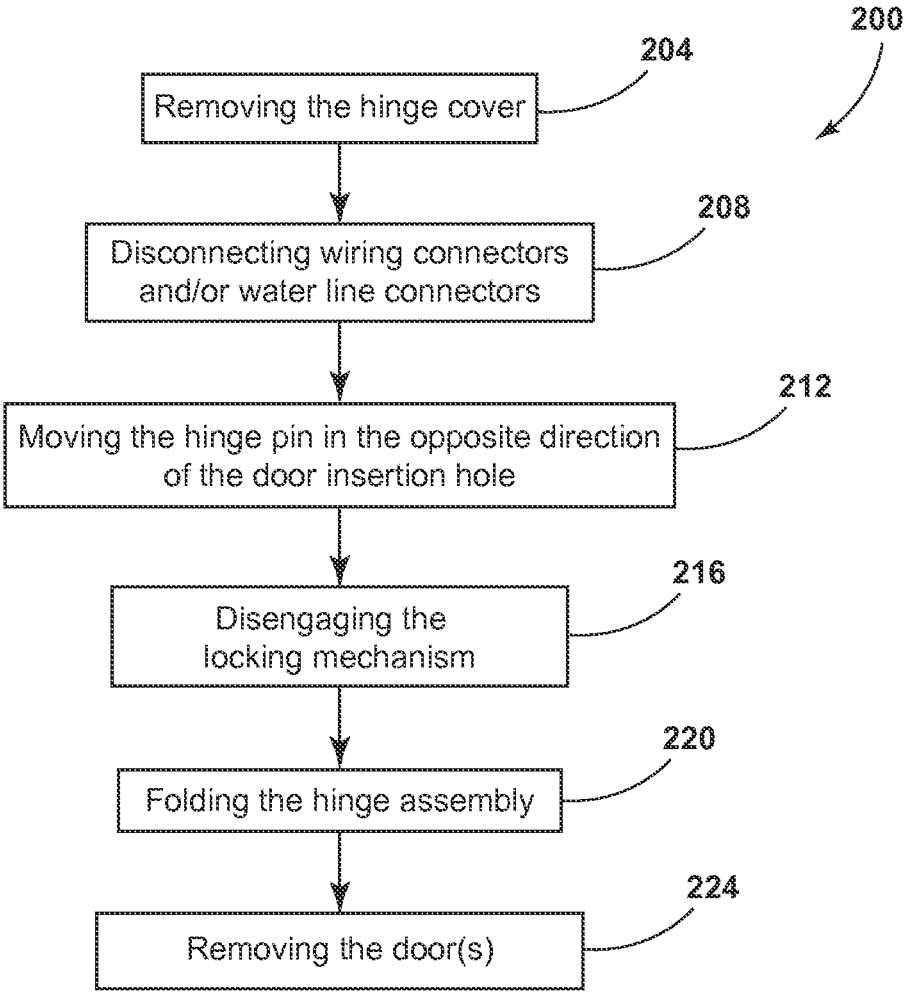
FIG. 5 is a flowchart for operating the hinge assembly, according to one embodiment.

Referring now to FIG. 5, depicted is a method 200 of decreasing the depth of the refrigerator 10 by removing the door(s) 22. The method 200 includes step 204, step 208, step 212, step 216, step 220, and step 224. The method 200 begins with step 204 of removing the hinge cover if present. Removal of the hinge cover permits access to the hinge assembly 26 as well as associated electrical wiring and water lines that pass between the door 22 and the cabinet 14. Next, step 208 of disconnecting wiring connectors and/or water line connectors is performed. The wiring and water line connectors may be tucked or otherwise secured out of the way prior to removal of the door(s) 22. In other embodiments, the water line and wiring may stay connected during the method 200. Next, step 212 of moving the hinge pin 66 in the opposite direction of the door insertion hole 74 is performed. As explained above, the hinge pin 66 may be threaded or otherwise configured to move away from the door insertion hole 74 such that interference between the door insertion hole 74 and the hinge pin 66 is minimized when the hinge assembly 26 is folded. Next, step 216 of disengaging the locking mechanism 50 of the hinge assembly 26 is performed. To disengage the locking mechanism 50, the slide lock 90 may be moved to the disengaged position to allow the door portion 34 of the hinge body 30 to rotate. In other embodiments of the hinge assembly 26, the nut 144 may be removed from the protrusion 136 or the slide bolt 120 may be disengaged from the eyelet 140 in order to allow the hinge assembly 26 to fold. Next, step 220 of folding the hinge assembly 26 is performed. The hinge assembly 26 may be folded only enough to maneuver the refrigerator 10 through a confined space. Finally, step 224 of removing the door(s) 22 is performed. Removal of the doors(s) 22 may take place by allowing the door(s) 22 to remain stationary while as the hinge assembly 26 is folded. Alternatively, the door(s) 22 may rotate with the hinge assembly 26 to some degree before removal. It will be understood that the steps of the method 200 may be performed in any order and/or simultaneously without departing from the spirit of this disclosure.

Use of the provided disclosure may offer several advantages. For example, by utilizing the disclosed hinge body 30, the fasteners 78 may not need to be removed when removing the door 22 from the cabinet 14. This may be advantageous in that it eliminates an opportunity for the alignment of the door 22 to the cabinet 14 to be altered from that intended. Additionally, the use of the disclosure allows user and movers of the refrigerator 10 to quickly and easily remove the door 22 form the cabinet 14 without the need for special tools or training. It will be understood that this disclosure may be equally applied to appliances other than just the refrigerator 10. For example, the hinge assembly 26 may be used in conjunction with a microwave oven, a conventional oven, cabinetry, commercial and residential doorways, and other uses.

In this specification and the appended claims, the singular forms "a," "an" and "the" include plural reference unless the context clearly dictates otherwise.

For the purposes of describing and defining the present teachings, it is noted that the terms "substantially" and "approximately" are utilized herein to represent the inherent degree of uncertainty that may be attributed to any quantitative comparison, value, measurement, or other representation. The term "substantially" and "approximately" are also utilized herein to represent the degree by which a quantitative representation may vary from a stated reference without resulting in a change in the basic function of the subject matter at issue.

It is to be understood that variations and modifications can be made on the aforementioned structure without departing from the concepts of the present disclosure, and further it is to be understood that such concepts are intended to be covered by the following claims unless these claims by their language expressly state otherwise.

What is claimed is:

1. A refrigerator comprising:

a cabinet having a cabinet wrapper;

a door coupled to the cabinet and operable between substantially open and closed positions; and a hinge assembly operatively coupled to the cabinet and to the door, the hinge assembly comprising:

a hinge body defining a door portion and a cabinet portion, the door portion coupled to the door and the cabinet portion coupled to an external side of the cabinet wrapper;

a foldable hinge connecting the door portion and the cabinet portion of the hinge body such that the door portion may rotate relative to the cabinet wrapper;

a reinforcement member positioned on an internal side of the cabinet wrapper and coupled to the hinge body; and body;

a hinge pin positioned on the door portion configured to engage the door, wherein the hinge pin has an axis of rotation that is substantially perpendicular to an axis of the foldable hinge; and a locking mechanism positioned on the door portion, wherein the locking mechanism extends through a lock aperture defined by the cabinet wrapper to lock the door portion in place configured to linearly slide in a direction perpendicular to the axis of the hinge pin.

2. The refrigerator of claim 1, wherein the reinforcement member further defines the lock aperture.

3. The refrigerator of claim 2, wherein the locking mechanism passes through the lock aperture of the reinforcement member.

4. The refrigerator of claim 1, further comprising:

at least one fastener disposed through the cabinet portion to the reinforcement member.

5. A refrigerator comprising:

a cabinet having a cabinet wrapper;

a door coupled to the cabinet; and a hinge assembly operatively coupled to the cabinet and to the door, the hinge assembly comprising:

a hinge body defining a door portion and a cabinet portion, the door portion comprising a hinge pin to which the door is rotatably coupled, wherein the cabinet portion is coupled to the cabinet;

a foldable hinge connecting the door portion and the cabinet portion of the hinge body such that the door portion is rotatable;

a reinforcement member; and a locking mechanism, wherein the locking mechanism is directly positioned on the door portion and is configured to engage the protrusion, wherein the door is configured to rotate between substantially open and closed positions about an axis substantially perpendicular to an axis of the foldable hinge and further wherein the locking mechanism is configured to linearly slide in a direction perpendicular to the axis of both the hinge and the door.

6. The refrigerator of claim 5, wherein the hinge body and the reinforcement member are positioned on opposite sides of the cabinet wrapper.

7. The refrigerator of claim 6, wherein at least one fastener extends between the cabinet portion of the hinge body and the reinforcement member.

8. A refrigerator door hinge assembly, comprising:

a hinge body defining a door portion and a cabinet portion, the door portion and the cabinet portion coupled through a foldable hinge such that the door portion may pivot relative to the cabinet portion;

a hinge pin positioned on the door portion configured to engage a refrigerator door, wherein the hinge pin has an axis of rotation that is substantially perpendicular to an axis of the foldable hinge;

a reinforcement member coupled to the hinge body; and a locking mechanism positioned on the hinge body and passing through the door portion such that the relative motion between the door portion and the cabinet portion is prevented, wherein the locking mechanism is configured to linearly slide in a direction perpendicular to the axis of at least one of the hinge pin and the foldable hinge.

9. The refrigerator door hinge assembly of claim 8, wherein the lock mechanism passes through a cabinet wrapper.

10. The refrigerator door hinge assembly of claim 8, wherein the lock mechanism defines a lock tab.

11. The refrigerator door hinge assembly of claim 8, wherein at least one fastener extends between the cabinet portion of the hinge body and the reinforcement member.

* * * * *